US005496160A

United States Patent [19]

Richardson, Jr. et al.

[11] Patent Number: 5,496,160

[45] Date of Patent: Mar. 5, 1996

[54] SCROLL COMPRESSOR HAVING A SUCTION CHECK VALVE

[75] Inventors: Hubert Richardson, Jr., Brooklyn; Todd W. Herrick, Tecumseh, both of Mich.

[73] Assignee: Tecumseh Products Company, Tecumseh, Mich.

[21] Appl. No.: 498,021

[22] Filed: Jul. 3, 1995

[51] Int. Cl.[6] ..... F01C 1/04

[52] U.S. Cl. ..... 418/55.1; 137/527

[58] Field of Search ..... 418/55.1, 270; 417/410.4; 137/527, 527.8

[56] References Cited

U.S. PATENT DOCUMENTS

| | | | |
|---|---|---|---|
| 3,834,846 | 9/1974 | Linder et al. . | |
| 4,065,279 | 12/1977 | McCullough . | |
| 4,216,661 | 8/1980 | Tojo et al. . | |
| 4,396,364 | 8/1983 | Tojo et al. . | |
| 4,431,388 | 2/1984 | Eber et al. . | |
| 4,443,166 | 4/1984 | Ikegawa et al. . | |
| 4,545,747 | 10/1985 | Tamura et al. . | |
| 4,560,330 | 12/1985 | Murayama et al. . | |
| 4,904,165 | 2/1990 | Fraser, Jr. et al. | 418/55.1 |
| 5,088,905 | 2/1992 | Beagle . | |
| 5,346,375 | 9/1994 | Akiyama et al. | 418/55.1 |

FOREIGN PATENT DOCUMENTS

| | | |
|---|---|---|
| 60-101296 | 6/1985 | Japan . |
| 1-177481 | 7/1989 | Japan . |
| 2-264177 | 10/1990 | Japan . |
| 3-96679 | 4/1991 | Japan . |
| 3-130588 | 6/1991 | Japan . |
| 4-72485 | 3/1992 | Japan . |
| 4-330393 | 11/1992 | Japan . |
| 4-350377 | 12/1992 | Japan . |

*Primary Examiner*—Charles Freay
*Attorney, Agent, or Firm*—Baker & Daniels

[57] ABSTRACT

A compressor is provided with a check valve which is disposed in a suction chamber adjacent a suction port opening. The check valve provides fast response and enhanced operating characteristics for preventing reverse refrigerant flow and reverse scroll operation during compressor shutdown. During normal compressor operation the check valve is open to allow communication of refrigerant into the suction chamber where the refrigerant is acted upon by the scroll mechanism and discharged through a discharge port. A positive pressure differential exists between the discharge port and the suction port which unimpeded causes reverse scroll operation upon compressor shutdown. The positive pressure condition in the suction chamber forces the check valve to pivot to a closed position whereby it covers and substantially seals the suction port. By preventing reverse refrigerant flow through the suction port the check valve effectively eliminates the pressure differential and thereby prevents reverse scroll operation.

13 Claims, 4 Drawing Sheets

SCROLL COMPRESSOR HAVING A SUCTION CHECK VALVE

BACKGROUND OF THE INVENTION

The invention generally relates to hermetic scroll compressors and more particularly to check valves for preventing the reverse flow of refrigerant through the scroll compressor which may occur upon stopping compressor operation. When compressor operation is stopped and the orbiting scroll member is no longer driven so as to orbit about the fixed scroll member, a reverse pressure differential occurs resulting in the reverse flow of refrigerant which urges the orbiting scroll member to move in the reverse direction. This causes undesirable noise.

U.S. Pat. No. 5,088,905 (Beagle) discloses a scroll compressor check valve which includes a valve member and a support member positioned directly adjacent the scroll discharge port for preventing reverse scroll operation upon compressor shutdown. A problem associated with this design is that with the check valve located outside of the scroll mechanism undesirable noise is realized outside of the compressor. In addition, with the valve positioned in the discharge chamber, response time is adversely affected because of the large volume of discharge gas associated with the discharge chamber.

U.S. Pat. No. 4,560,330 (Muriyama et al) discloses a scroll compressor having a spring biased fluid check valve disposed in a refrigerant suction passageway which moves to an open position during compressor operation so as to allow refrigerant to communicate through an intake pipe to the suction chamber defined by scroll members. During compressor shutdown the fluid check valve moves to a closed position so as to prevent reverse flow of refrigerant from the suction chamber back into the intake pipe thereby preventing reverse scroll member rotation. A problem associated with the Muriyama design is that during compressor startup and while the compressor is running energy must be expended to act against the spring bias to open and hold open the check valve. In addition, this design is sensitive to dirt jamming the piston valve.

Problems associated with earlier check valve assemblies include heightened expense related to complex spring biased and multi-part assemblies, noise generated by valves in the discharge chamber snapping into place, sluggish reaction time, and lower efficiencies to name a few.

SUMMARY OF THE INVENTION

The scroll compressor suction check valve of the present invention consists generally of a light weight plastic or metallic flap valve that is positioned adjacent to the suction port in the scroll mechanism of the scroll compressor. During normal scroll compressor operation discharge pressure refrigerant is discharged through the discharge port and suction pressure refrigerant is drawn into the scroll mechanism through the suction port. The incoming refrigerant acts upon the flap valve causing it to move to an open position.

Upon compressor shutdown, the pressure differential between the discharge port and the suction port urges the scroll mechanism to orbit in the reverse direction as the refrigerant attempts to move from the discharge port and the compression chambers to the suction port. Unless prevented, the scroll mechanism orbits in this reverse manner resulting in an undesirable winding noise. The present invention is aimed at preventing this in a most effective and efficient manner. As the refrigerant moves from the discharge port to the suction chamber and through the suction port, it acts upon the flap valve causing it to move to a closed position thereby blocking the reverse flow of refrigerant through the suction port and preventing reverse orbiting of the scroll mechanism. The discharge pressure refrigerant and refrigerant contained within the scroll compression chambers act upon the scroll mechanism causing the orbiting scroll member to radially separate from the fixed scroll member. With the scroll members no longer sealed with one another, the refrigerant is permitted to leak through the scroll member spirals and the pressure within the scroll mechanism reaches equilibrium.

By placing the flap valve in the suction chamber, where the volume is low as compared with the volume of the discharge chamber, the sensitivity of the flap valve to changing refrigerant flow is maximized. This results in enhanced flap valve response during compressor shutdown. In addition, the shape and construction of the flap valve enhances valve responsiveness. The flap valve has a large generally rectangular, curved surface area with which to engage the refrigerant flow. The valve has a thin cross-section and is lightweight relative to its large surface area. This configuration permits the valve to respond quickly to a change in the direction of refrigerant flow.

In one embodiment, the flap valve is pivotally attached to the fixed scroll member by a pivot pin that is press-fit into a receiving bore provided in the fixed scroll member. In a scroll mechanism assembly, the spiral wraps of an orbiting scroll member are intermeshed with the spiral wraps of the fixed scroll member. The flap valve of the present invention is mounted to the fixed scroll member directly adjacent a refrigerant suction inlet port. The flap valve is disposed in a suction chamber which is defined by the intermeshed scroll members.

One advantage associated with the present invention is that by disposing the flap valve in the suction chamber formed in the scroll cavity, noise produced during flap valve operation is reduced.

Another advantage associated with the present invention is that due to the relatively small volume associated with the scroll suction chamber, faster flap valve reaction time is realized.

Yet one more advantage of the present invention is in its uncomplicated structure which requires only a valve flap, a pivot pin, and simple fixed scroll machining modifications.

In one embodiment, the invention provides a scroll compressor having an orbiting scroll member and a fixed scroll member each having an end plate and a spiral wrap protruding perpendicularly from the end plate. The scroll members are assembled so that the wraps face opposite one another and mesh with one another so as to define therebetween compression chambers which are formed during compressor operation. The scroll compressor includes an apparatus for effectuating orbital movement of the orbiting scroll member relative to the fixed scroll member. During orbital movement of the orbiting scroll member the scroll members draw refrigerant into a compression chamber from a suction port and discharge refrigerant from a compression chamber out through a discharge port. The orbital movement causes the volumes of the compression chambers to progressively decrease as the chambers are progressed along the scroll members towards the discharge port.

A refrigerant suction port is formed in the fixed scroll member and a suction chamber is formed between the scroll members such that the suction chamber is in communication with the suction port. A flap valve is provided to prevent reverse refrigerant flow from the suction chamber back through the suction port upon compressor shutdown. The flap valve thereby prevents reverse orbital movement of the orbiting scroll member. The flap valve is pivotally mounted to the fixed scroll member and is disposed in the suction chamber. The flap valve pivots to an open position allowing communication of refrigerant from the suction port into the suction chamber during compressor operation. The flap valve pivots about a pivot point to a closed position so as to substantially cover the suction port when refrigerant begins to flow from the suction chamber back into the suction port during compressor shutdown.

BRIEF DESCRIPTION OF THE DRAWINGS

The above-mentioned and other features and objects of this invention, and the manner of attaining them, will become more apparent and the invention itself will be better understood by reference to the following description of an embodiment of the invention taken in conjunction with the accompanying drawings, wherein.

Figure 1:
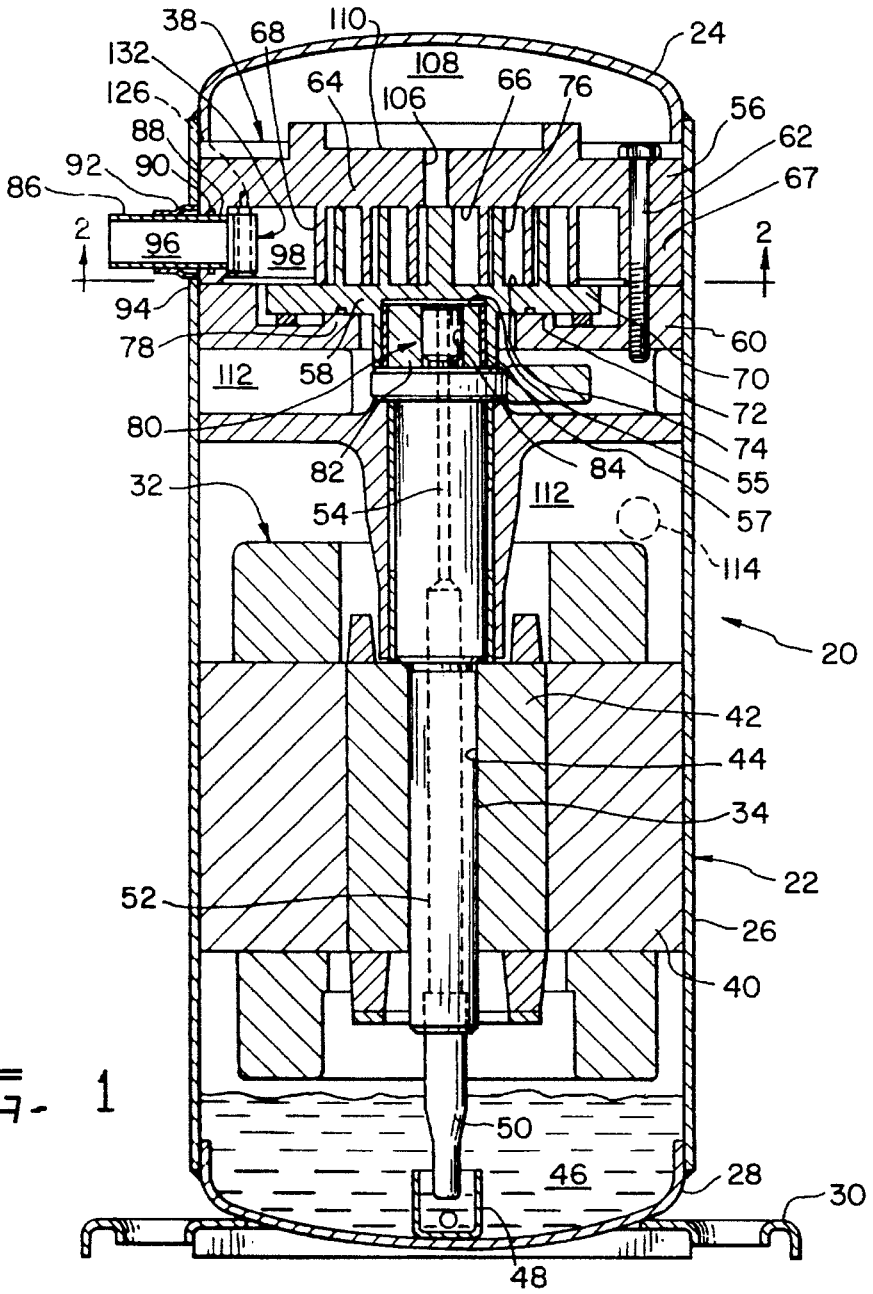
FIG. 1 is a cross-sectional view of the scroll compressor of the present invention.

Corresponding reference characters indicate corresponding parts throughout the several views. The exemplifications set out herein illustrate a preferred embodiment of the invention, in one form thereof, and such exemplifications are not to be construed as limiting the scope of the invention in any manner.

DETAILED DESCRIPTION OF THE INVENTION

In an exemplary embodiment of the invention as shown in the drawings, scroll compressor 20 is shown in one embodiment which is only provided as an example to which the invention is not limited. U.S. Pat. No. 5,306,126, issued to the assignee of the present invention and incorporated herein by reference, provides a detailed description of the operation of a scroll compressor which is compatible with the present invention.

Referring now to FIG. 1, scroll compressor 20 is shown having housing 22 consisting of upper portion 24, central portion 26 and lower portion 28. In an alternative form central portion 26 and lower portion 28 may be combined as a unitary lower housing member. Housing portions 24, 26, and 28 are hermetically sealed and secured together by such processes as welding or brazing. Mounting flange 30 is secured to lower housing portion 28 for mounting compressor 20 in a vertical upright position. Within housing 22 is electric motor 32, crankshaft 34, and scroll mechanism 38. Motor 32 includes stator 40 and rotor 42 which has aperture 44 into which is received crankshaft 34. Oil collected in oil sump 46 is collected in oil cup 48 by centrifugal oil pickup tube 50. The oil is then communicated along passageways 52 and 54 whereby it is delivered to and fills chamber 55 and well 57.

Scroll compressor mechanism 38 generally comprises fixed scroll member 56, orbiting scroll member 58, and main bearing frame member 60. Fixed scroll member 56 is fixably secured to main bearing frame member 60 by a plurality of mounting bolts 62. Fixed scroll member 56 comprises generally flat face plate 64, face surface 66, sidewall 67 and an involute fixed wrap 68 which extends axially downwards from surface 66. With compressor 20 in a de-energized mode, back surface 72 of orbiting scroll plate 70 engages main bearing member 60 at thrust bearing surface 78. Orbiting scroll member 58 comprises generally flat face plate 70, back surface 72, top face surface 74, and involute orbiting wrap 76 which extends axially upwards from top surface 74.

Scroll mechanism 38 is assembled with fixed scroll member 56 and orbiting scroll member 58 intermeshed so that fixed wrap 68 and orbiting wrap 76 operatively interfit with each other. To insure proper compressor operation, face surfaces 66 and 74 and wraps 68 and 76 are manufactured so that when fixed scroll member 56 and orbiting scroll member 58 are forced axially toward one another, the tips of wraps 68 and 76 sealingly engage with respective opposite face surfaces 66 and 74. During compressor operation back surface 72 of orbiting scroll member 58 becomes axially spaced from thrust surface 78 in accordance with strict machining tolerances and the amount of permitted axial movement of orbiting scroll member 58 towards fixed scroll member 56. Situated on the top of crankshaft 34 is eccentric crank mechanism 80 which consists of cylindrical roller 82 having offset axial bore 84. When crankshaft 34 is caused to rotate by motor 32, cylindrical roller 82 and an Oldham ring cause orbiting scroll member 58 to orbit with respect to fixed scroll member 56. In this manner eccentric crank mechanism 80 functions as a conventional swing-link radial compliance mechanism to promote sealing engagement between fixed wrap 68 and orbiting wrap 76.

Figure 2:
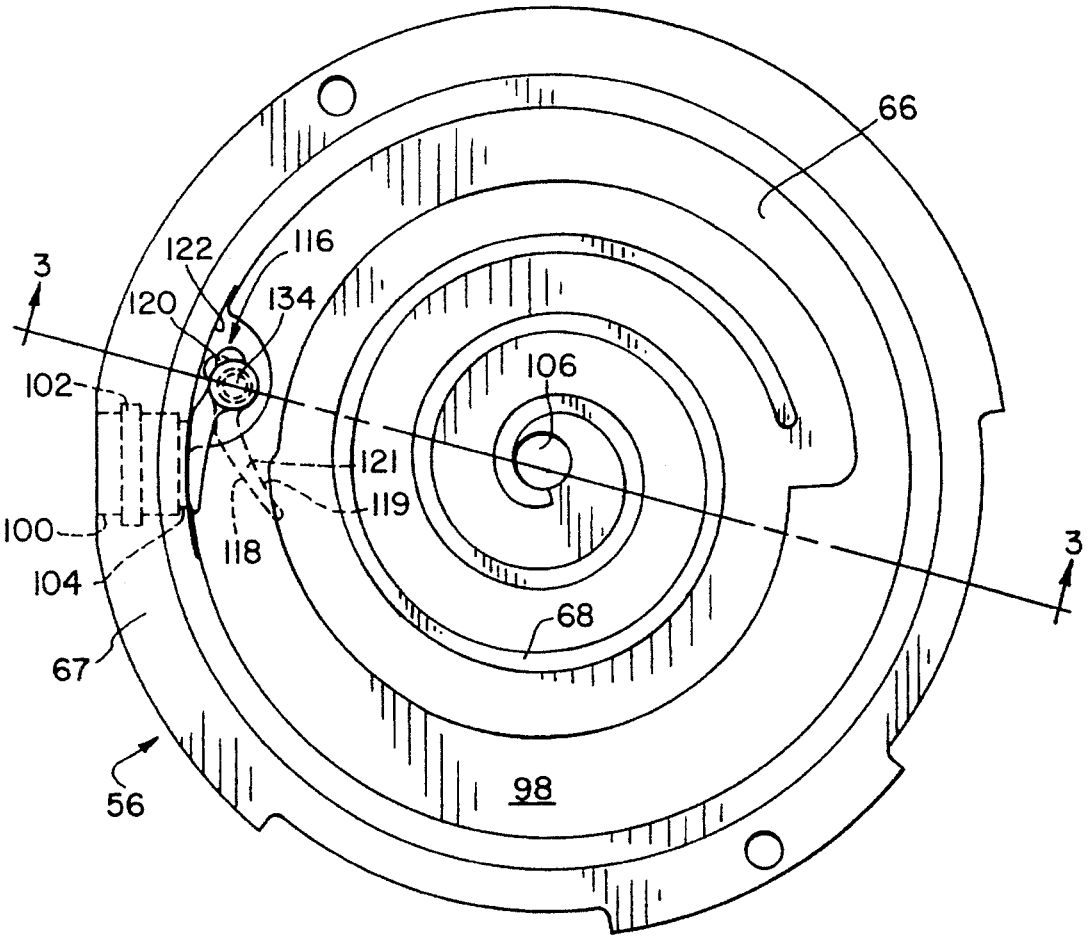
FIG. 2 is a bottom view of the fixed scroll member of the scroll compressor of FIG. 1 showing the suction port flap valve of the present invention.

With compressor 20 in operation, refrigerant fluid at suction pressure is introduced through suction tube 86, which is sealingly received into counterbore 88 in fixed scroll member 56. The sealing of suction tube 86 with counterbore 88 is aided by the use of O-ring 90. Suction tube 86 is secured to compressor 20 by suction tube adapter 92 which is brazed or soldered to suction tube 86 and opening 94 of housing 22. Suction tube 86 provides a suction pressure refrigerant passage 96 through which refrigerant fluid is communicated from a refrigerant system to suction pressure chamber 98 which is defined by fixed scroll member 56 and frame member 60. As shown in FIG. 2, suction port 100 in fixed scroll member 56 receives suction tube 86 and annular O-ring 90 in channel 102 for proper sealing of suction tube 86 with fixed scroll 56.

Suction pressure refrigerant travels along suction passage 96, exits through suction port opening 104 and enters suction chamber 98 for compression by scroll mechanism 38. As orbiting scroll member 58 is caused to orbit with respect to fixed scroll member 56, refrigerant fluid within suction chamber 98 is captured and forms closed pockets of compressed refrigerant as defined by fixed wrap 68 and orbiting wrap 76. As orbiting scroll member 58 continues to orbit, pockets of refrigerant are progressed radially inwardly towards discharge port 106. As the refrigerant pockets are progressed along scroll wraps 68 and 76 towards discharge port 106 their volumes are progressively decreased, thereby causing an increase in refrigerant pressure. Refrigerant fluid at discharge pressure is discharged upwardly through discharge port 106 and is communicated through face plate 64 of fixed scroll member 56. The refrigerant is expelled into discharge plenum chamber 108 as defined by upper housing portion 24 and top surface 110 of fixed scroll member 56. The compressed refrigerant is introduced into housing chamber 112 where it exits through discharge tube 114 into a refrigeration system in which compressor 20 is incorporated.

Scroll mechanism 38 is provided with flap valve assembly 116 for preventing the reverse flow of refrigerant upon compressor shutdown, thereby preventing the reverse orbiting of scroll mechanism 38. Flap valve assembly 116 comprises rectangular curved flap 132 having front face 118, rear face 119, top edge 121, and bottom edge 123. In one embodiment front and rear faces 118 and 119 have a surface area at least three times the surface area of either the top or bottom edges 121 and 123.. The refrigerant acts upon front and rear faces 118 and 119 thereby causing flap 132 to pivot. The check valve pivots between an open position and a closed position. The angle formed between the open and the closed positions is between approximately 35 degrees and 55 degrees. The valve is arranged to pivotally open in the direction of the orbiting scroll orbit.

During normal compressor operation a negative pressure differential occurs in suction chamber 98 caused by the difference in pressures associated with suction pressure refrigerant at suction port 100 as compared with higher discharge pressure refrigerant at discharge port 106. This negative pressure condition results in the inflow of suction pressure refrigerant from suction tube 96 through suction port 100 and into suction chamber 98. The inrushing refrigerant acts upon front face 118 of flap valve assembly 116 and forces it to an open position, thereby allowing the communication of the refrigerant into scroll mechanism 38. With flap valve assembly 116 in an open position, position limiting stop 120 engages inner wall 122 of fixed scroll member 56, thereby limiting the range of movement of flap valve assembly 116. Flap valve 116 is maintained in this stable open position during normal compressor operation.

Upon compressor shutdown, orbiting scroll member 58 is no longer orbitally driven by motor 32 and crankshaft 34 in its normal manner and is free to move in response to ambient conditions, including the pressure differential between discharge port 106 and suction port 100. Unimpeded, this pressure differential acts upon orbiting scroll member 58 so as to cause it to orbit in a reverse manner with respect to fixed scroll member 56. Such reverse orbiting results in refrigerant flowing from discharge port 106 in a reverse direction and exiting through suction port 100.

This problem of reverse scroll rotation during compressor shutdown has long been associated with scroll compressors. Flap valve assembly 116 is provided to alleviate this problem. During compressor shutdown a positive pressure condition arises in suction chamber 98 causing refrigerant to move toward and out suction port 100. The refrigerant acts against the large surface area of rear face 119 of flap 132 causing it to pivot about pivot pin 124 and engage inner wall 122 in such a manner that front face 118 covers and substantially seals suction port opening 104. In this manner refrigerant is prevented from flowing in a reverse direction from suction chamber 98 into and through suction passage 96. Moreover, with suction port 100 effectively sealed off from suction chamber 98 the pressure differential is effectively eliminated thereby preventing reverse orbiting of orbit scroll member 58. The discharge pressure refrigerant and the refrigerant contained within scroll compression chambers act upon scroll mechanism 38 causing orbiting scroll member 58 to radially separate from fixed scroll member 56. With scroll members 56 and 58 no longer sealed with one another, the refrigerant contained therein is permitted to leak through scroll member wraps 68 and 76 and the pressure within scroll mechanism 38 reaches equilibrium.

Figure 3:
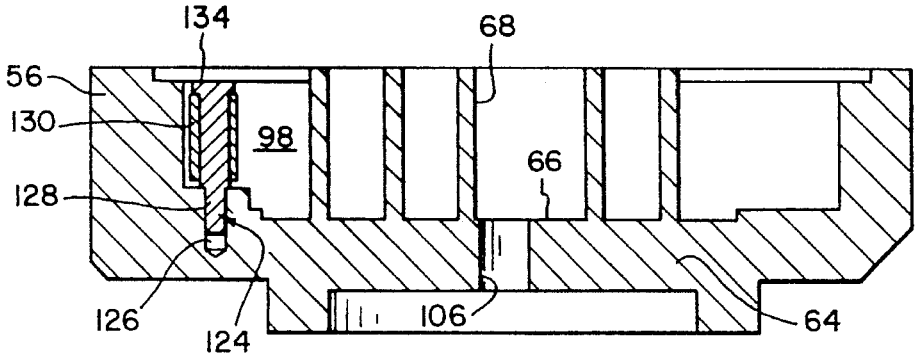
FIG. 3 is a cross-sectional view of the fixed scroll member of FIG. 2 showing in cross-section the suction port flap valve.
Figure 4:
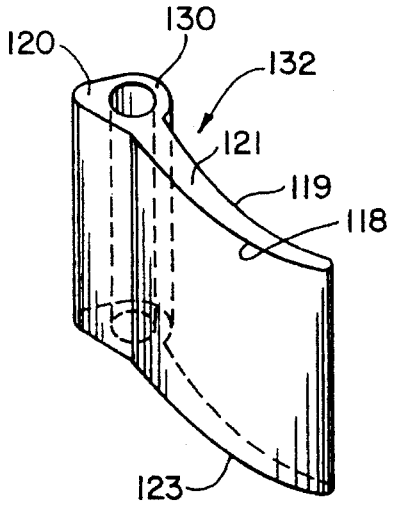
FIG. 4 is a perspective view of the suction port flap valve of FIG. 2.
Figure 4A:
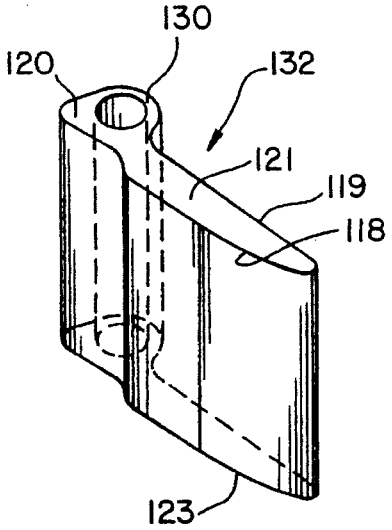
FIG. 4*a* is a perspective view of an alternative embodiment of the suction port flap valve of FIG. 4.

Referring now to FIGS. 3 and 4, shaft 128 of pivot pin 130 is press-fit into counterbore 126 which is provided in fixed scroll member 56. Axially extending collar 130 of flap 132 surrounds and is pivotally supported by shaft 128 of pivot pin 124. The diameter of shaft 128 is slightly less than the inner diameter of collar 130 thereby allowing free movement of flap 132 about pivot pin 124. Head 134 is provided on shaft 128 to limit the axial movement of flap 132 and to hold the flap in proper alignment for covering suction port opening 104. Flap 132 is preferably made of either plastic or aluminum. FIG. 4a illustrates the suction port flap valve 132 of FIG. 4 in an alternative embodiment.

Figure 5A:
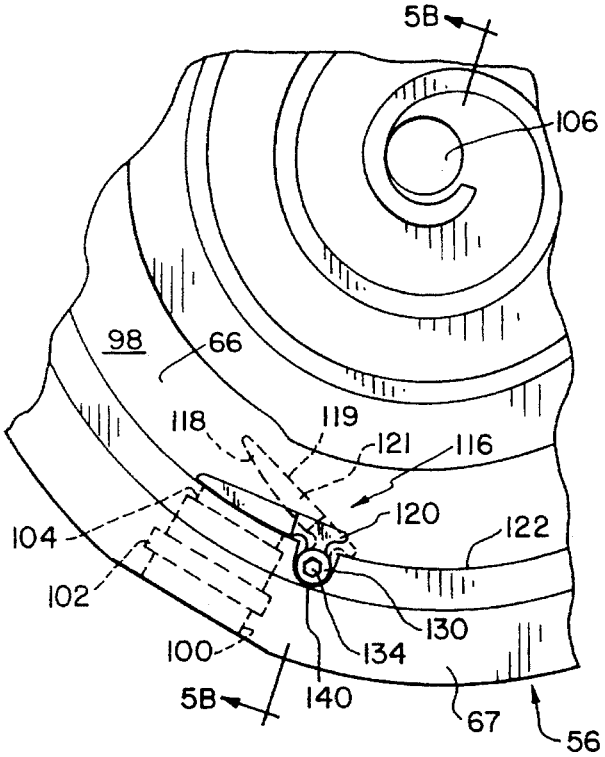
FIG. 5*a* is a fragmentary bottom view of the fixed scroll of FIG. 2 showing the suction port flap valve in an alternative embodiment.
Figure 5B:
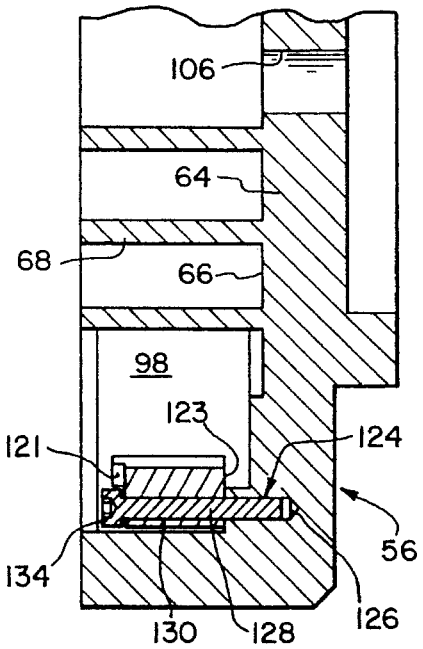
FIG. 5*b* is a partial cross-sectional view of the fixed scroll member showing the alternative embodiment suction port flap valve of FIG. 5*a;*
Figure 5C:
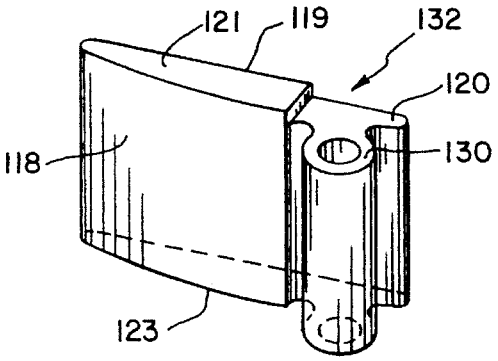
FIG. 5*c* is a perspective view of the alternative embodiment suction port flap valve of FIG. 5*a;*

Referring now to FIGS. 5*a*, 5*b* and 5*c*, fixed scroll member 56 is provided with flap valve assembly 116 for preventing the reverse flow of refrigerant upon compressor shutdown. During normal compressor operation and upon compressor shutdown, refrigerant acts upon front and rear faces 118 and 119 so as to cause flap 132 to pivot about pivot pin 124 respectively between open and closed portions. Due to a negative pressure differential occurring in suction chamber 98 during normal compressor operation, refrigerant is caused to flow from suction port 100 into suction chamber 98. The inrushing refrigerant impacts upon front face 118 of flap valve 132 causing it to pivot in the clockwise direction about pivot pin 124, thereby allowing the communication of the refrigerant into scroll mechanism 38. During compressor operation, position limiting stop 120 engages inner wall 122 of fixed scroll member 56, thereby limiting the pivotal movement of flap valve assembly 116.

Upon compressor shutdown as described above, a positive pressure condition arises in suction chamber 98 which urges the refrigerant to move in a reverse direction from suction chamber 98 towards suction port 100. This reverse movement of the refrigerant acts upon rear face 119 of flap 132 thereby causing it to pivot about pivot pin 124 so that flap 132 engages inner wall 122 in such a manner that front face 118 covers and substantially seals suction port opening 104. The positive pressure condition is effectively eliminated thereby preventing reverse orbiting of orbiting scroll member 58. Orbiting scroll member 58 radially separates from fixed scroll member 56, thereby relieving the pressure differential within scroll mechanism 38.

Although the structure depicted in FIGS. 5*a*, 5*b* and 5*c* functions essentially the same as the structure described in FIGS. 1–4, the configuration of flap assembly 116 and the method of mounting the flap in fixed scroll 56 is different.

Fixed scroll 56 is provided with recess 140 and inner wall 122 into which is received tubular collar 130 of flap 132. Flap 132 is pivotally held in place by pivot pin 124 which is received within the opening formed by collar 130 and disposed in counterbore 126 formed in fixed scroll member 56. Pivot pin 124 is provided with head 134 or other retention means for preventing the axial movement of flap 132.

Figure 6A:
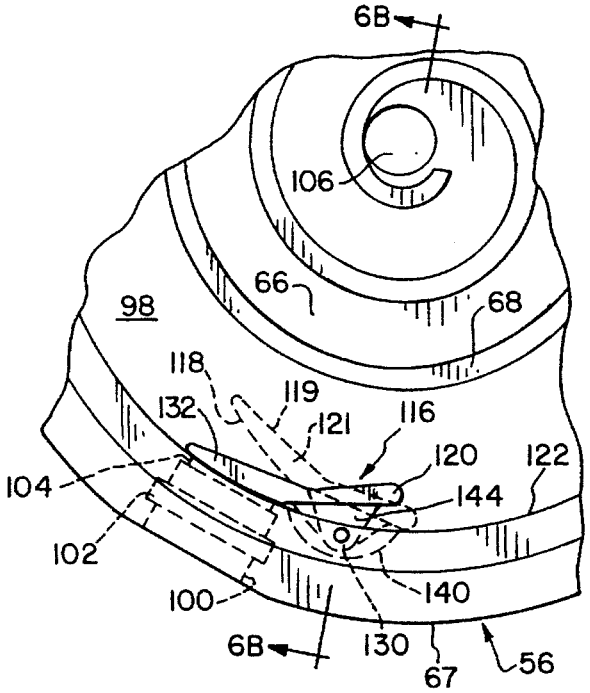
FIG. 6*a* is a fragmentary bottom view of the fixed scroll member showing the suction port flap valve in a second alternative embodiment.
Figure 6B:
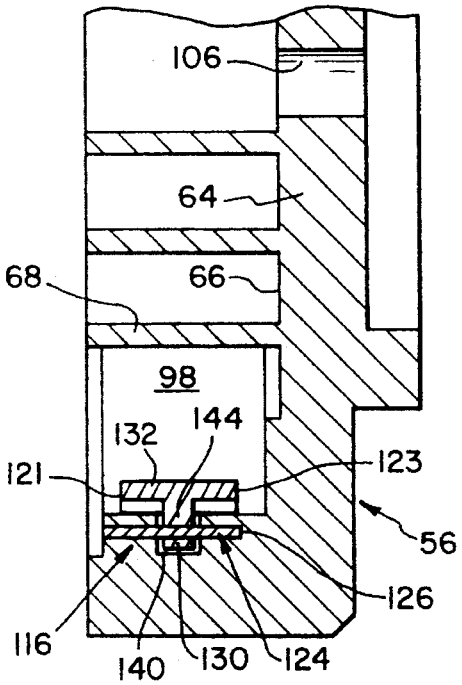
FIG. 6*b* is a partial cross-sectional view of the fixed scroll member of FIG. 6*a* showing the second alternative embodiment suction port flap valve.
Figure 6C:
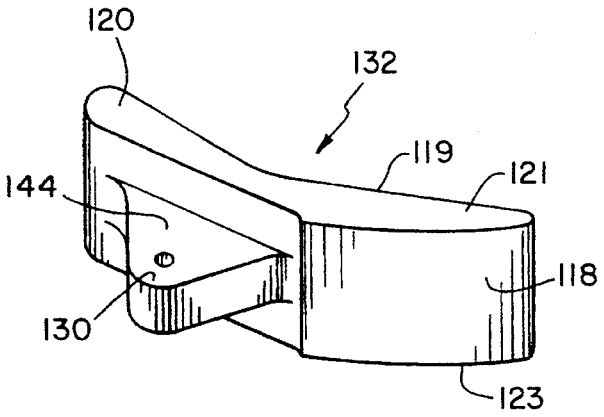
FIG. 6*c* is a perspective view of the second alternative embodiment suction port flap valve of FIG. 6*a*.

Referring now to FIGS. 6*a*, 6*b* and 6*c*, flap 132 is shown in a second alternative embodiment which functions essentially as the prior flap embodiments described hereinabove. Fixed scroll member 56 is provided with recess 140 into which is received pivot extension arm 144. Flap 132 is pivotally held in place by pivot pin 124, which in one form can be a spring pin and which is disposed in counterbore 126, and collar 130 so as to prevent the axial movement of flap 132 and to allow the pivotal movement of flap 132 from open to closed positions.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A scroll compressor comprising:

an orbiting scroll member and a fixed scroll member each having an end plate and a spiral wrap, said spiral wraps being intermeshed to define therebetween compression chambers;

a suction port and a discharge port, said suction port extending through said fixed scroll member;

a suction chamber formed between said scroll, members, said suction chamber in communication with said suction port, said suction port having an opening adjacent said suction chamber; and a check valve for preventing reverse refrigerant flow from said suction chamber back through said suction port thereby preventing reverse orbital movement of said orbiting scroll member, said valve being pivotally mounted to said fixed scroll member and being disposed in said suction chamber, said valve pivoting about a pivot point so as to substantially cover and seal said suction port to substantially prevent the reverse flow of refrigerant upon compressor shutdown.

2. The scroll compressor of claim 1, wherein said check valve pivots between an open position and a closed position, and wherein the angle formed between said open and closed positions is between approximately 35 degrees and 55 degrees.

3. The scroll compressor of claim 1, wherein said check valve pivotally opens in the direction of said orbiting scroll orbit.

4. The scroll compressor of claim 1, wherein said suction port is formed in a sidewall of said fixed scroll member.

5. The scroll compressor of claim 1, wherein said check valve comprises a flap, a position limiting stop and a pivot pin, said flap pivoting about said pivot pin between an open position and a closed position and being shaped such that in the closed position said flap substantially covers and seals said suction port, in said open position said valve allowing communication of refrigerant from said suction port into said suction chamber, said pivot pin being supported by said fixed scroll member.

6. The scroll compressor of claim 5, wherein said pivot pin comprises a shaft and a head, said flap having an axially extending collar for receiving said pin shaft, said collar having a diameter slightly larger than the diameter of said shaft thereby allowing said flap to freely pivot about said shaft, said fixed scroll member having a circular bore for receiving said pivot pin shaft, said pivot pin being press-fit into said circular bore to form said pivot point, said fixed scroll thereby providing pivotal support for said check valve, said pin head being positioned at an opposite end of said shaft from said circular bore, said head restricting the axial movement of said flap thereby preventing said flap from sliding off of said shaft.

7. The scroll compressor of claim 5, wherein said suction port is formed through a vertical exterior wall of said fixed scroll member, said wall having a curved inner surface, said suction port having an opening formed on the inside of said curved surface, said flap being curved so that upon discontinuing compressor operation said flap pivots to the closed position and engages said curved surface, said suction port is thereby substantially covered and sealed so as to prevent the reverse flow of refrigerant and the reverse orbiting of the scroll compressor.

8. The scroll compressor of claim 1, wherein said check valve comprises a rectangular curved flap having a front face, a rear face, a top edge and a bottom edge, each of said front and rear faces having a surface area at least three times the surface area of either of said top and bottom edges, said refrigerant acting upon said front and rear faces of said check valve thereby causing said check valve to pivot.

9. The scroll compressor of claim 1, wherein said check valve is made from one of a group including aluminum, plastic and steel.

10. In a scroll compressor comprising an orbiting scroll member, a fixed scroll member, a suction port, a discharge port, and a suction chamber, wherein the suction chamber is formed between the scroll members such that the suction chamber is in communication with the suction port, and wherein the orbiting scroll member orbits about the fixed scroll member so as to draw in refrigerant from the suction port and discharge refrigerant through the discharge port, a check valve for preventing reverse refrigerant flow from the suction chamber through the suction port and for preventing reverse orbital movement of the orbiting scroll member, said check valve comprising:

a flap being shaped such that in a closed position said flap substantially covers and seals the suction port;

a position limiting stop for limiting the pivotal movement of said flap; and a pivot pin having a shaft and a head, said flap having an axially extending collar for receiving said pin shaft, said collar having a diameter slightly larger than the diameter of said pin shaft thereby allowing said flap to freely pivot about said pin shaft, the fixed scroll member having a circular bore for receiving said pin shaft, said pivot pin being press-fit into said circular bore to form a pivot point, the fixed scroll thereby providing pivotal support for said check valve, said pin head being positioned at an opposite end of said pin shaft from said circular bore, said head restricting the axial movement of said flap thereby preventing said flap from sliding off of said pin shaft, said valve being disposed in the suction chamber, said valve pivoting to an open position and allowing communication of refrigerant through the suction port and into the suction chamber, said valve pivoting about said pivot point so as to substantially cover the suction port thereby substantially preventing the flow of refrigerant from the suction chamber into and through the suction port.

11. The check valve of claim 10, wherein said check valve pivots between a first open position and a second closed position, and wherein the angle formed between said first and second positions is between 35 degrees and 55 degrees.

12. The check valve of claim 10, wherein said check valve pivotally opens in the direction of the orbiting scroll rotation.

13. The check valve of claim 10 which is made from one of a group including aluminum, plastic, and steel.

* * * * *